US012372326B1

(12) United States Patent
O'Connor et al.

(10) Patent No.: US 12,372,326 B1
(45) Date of Patent: Jul. 29, 2025

(54) FIREARM ACCESSORY

(71) Applicants: Garry O'Connor, St. Albert (CA); Jeff Gulbrandsen, St. Albert (CA)

(72) Inventors: Garry O'Connor, St. Albert (CA); Jeff Gulbrandsen, St. Albert (CA)

( * ) Notice: Subject to any disclaimer, the term of this patent is extended or adjusted under 35 U.S.C. 154(b) by 23 days.

(21) Appl. No.: 18/413,127

(22) Filed: Jan. 16, 2024

(51) Int. Cl.

| | |
|---|---|
| ***F41C 23/16*** | (2006.01) |
| ***F41C 7/02*** | (2006.01) |
| *F41A 9/72* | (2006.01) |
| *F41G 1/35* | (2006.01) |

(52) U.S. Cl.
CPC ..... *F41C 23/16* (2013.01); *F41C 7/02* (2013.01); *F41A 9/72* (2013.01); *F41G 1/35* (2013.01)

(58) Field of Classification Search
CPC ..... F41C 23/04; F41C 23/14; F41C 23/16; F41C 27/06; F41C 27/02; F41A 3/84; F41A 11/02; F41A 3/66; F41A 11/04; F41A 19/10; F41A 3/26; F41A 35/06; F41A 9/72; F41B 7/08; F41G 1/35
USPC ..... 42/73, 1.06, 71.01, 72, 74, 71.02, 42/75.01–75.1; 89/191.01, 193, 198
See application file for complete search history.

(56) References Cited

U.S. PATENT DOCUMENTS 809,080 A * 1/1906 Wight ..... F41C 23/16 42/71.01
2,056,975 A * 10/1936 Michal, Jr. ..... F41C 23/12 42/106
2,104,129 A * 1/1938 Kress ..... F41C 23/16 42/74
4,837,961 A * 6/1989 Keenan ..... F41C 7/025 42/72
5,027,542 A * 7/1991 Simonetti ..... F41C 7/02 42/72
5,048,215 A * 9/1991 Davis ..... F41C 23/22 42/71.01
5,333,404 A * 8/1994 Lingyak ..... F41C 23/16 42/71.01
5,560,136 A * 10/1996 Cupp ..... F41C 23/10 42/71.02
5,711,102 A * 1/1998 Plaster ..... F41C 23/14 42/74
5,727,346 A * 3/1998 Lazzarini ..... F41G 1/35 42/146
8,056,277 B2 * 11/2011 Griffin ..... F41C 27/00 42/72
9,027,274 B2 * 5/2015 Pientka ..... F41A 23/18 42/94

(Continued)

*Primary Examiner* — Michael D David
(74) *Attorney, Agent, or Firm* — Orin Del Vecchio

(57) ABSTRACT

A shotgun pump handle that is slidably coupled to a magazine tube of a shotgun that includes a body having a replaceable grip member and a loop portion. The shotgun pump handle includes a body that is manufactured from aluminum or other similar material wherein the body includes a first end and a second end. A grip member is releasably secured to a lower portion of the body wherein the grip member is manufactured from foam rubber or similar material and is provided in alternate sizes. A loop member is integrally formed with the body wherein an end of the loop member is contiguous with the bottom portion of the body proximate the second end and the distal end is formed with the bottom of the body proximate the first end. The loop member creates a void for a human hand to be journaled thereinto.

6 Claims, 3 Drawing Sheets

(56) References Cited

U.S. PATENT DOCUMENTS

2016/0061560 A1* 3/2016 Saadon ..... F41G 1/35
42/72
2016/0146569 A1* 5/2016 Lemoine ..... F41C 23/16
42/6

* cited by examiner

FIREARM ACCESSORY

FIELD OF THE INVENTION

The present invention relates generally to shotgun accessories, more specifically but not by way of limitation, a pump handle for a shotgun wherein the pump handle includes a removable padded portion and a loop member. The present invention further incorporates a lighting member and laser into the pump handle.

BACKGROUND

All shotguns generally the same basic components. A typical shotgun a stock that allows you to steady it against your shoulder muscles. Some stocks include recoil pad at the end of the stock to help dampen recoil when the shotgun is fired. There are some shotguns that have foldaway stocks or no stock and employ a pistol grip style handle. Forward of the stock are the parts associated with firing. This includes the trigger that is operably coupled with the sear and hammer. The hammer activates the bolt assembly and firing pin, which rest against the cartridge to be fired. The chamber is typically accessible from the side or the top. Connecting to the chamber is the barrel which is the long tube that the ammunition travels through as it leaves the gun ensuing being fired.

Some shotguns have a magazine tube connected to the chamber that typically is a shorter tube below the barrel. Slidabaly coupled to the magazine tube is a part known as a fore-end, which is also commonly referred to as a pump or racker handle. The pump is used to partially automate the loading and unloading process wherein the user of the shotgun will slide the pump on the magazine tube which will facilitate unloading of a fired shell and loading of a new shell into the chamber to be fired. The common pump handle are generally rectangular in shape having a rounded bottom and some may be equipped with indentations for fingers. The conventional designs for shotgun pump handles while effective lack elements that could provide both comfort and improved engagement therewith.

Accordingly, there is a need for a shotgun pump handle that incorporates a replaceable grip member and further includes a loop member so as to facilitate improved operation of the shotgun pump handle.

SUMMARY OF THE INVENTION

It is the object of the present invention to provide a shotgun pump handle that is operably coupled to a magazine tube of a shotgun wherein the present invention includes a body that is manufactured from cast aluminum.

Another object of the present invention is to provide a shotgun racker handle configured to be slidably coupled to a shotgun magazine tube wherein the body of the present invention includes a replaceable grip member.

A further object of the present invention is to provide a shotgun pump handle that is operably coupled to a magazine tube of a shotgun wherein the grip member is provided in alternate sizes and manufactured from a material such as but not limited to foam rubber.

Yet a further object of the present invention is to provide a shotgun racker handle configured to be slidably coupled to a shotgun magazine tube wherein the body further includes a loop member that extends downward from the bottom thereof.

Still another object of the present invention is to provide a shotgun pump handle that is operably coupled to a magazine tube of a shotgun wherein the loop member is integrally formed with the body and creates a void of suitable size to accommodate a hand therein.

An additional object of the present invention is to provide a shotgun racker handle configured to be slidably coupled to a shotgun magazine tube wherein the first end of the body further includes a light member configured to project light forward of the shotgun.

Yet a further object of the present invention is to provide a shotgun pump handle that is operably coupled to a magazine tube of a shotgun wherein the present invention further includes a laser member.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
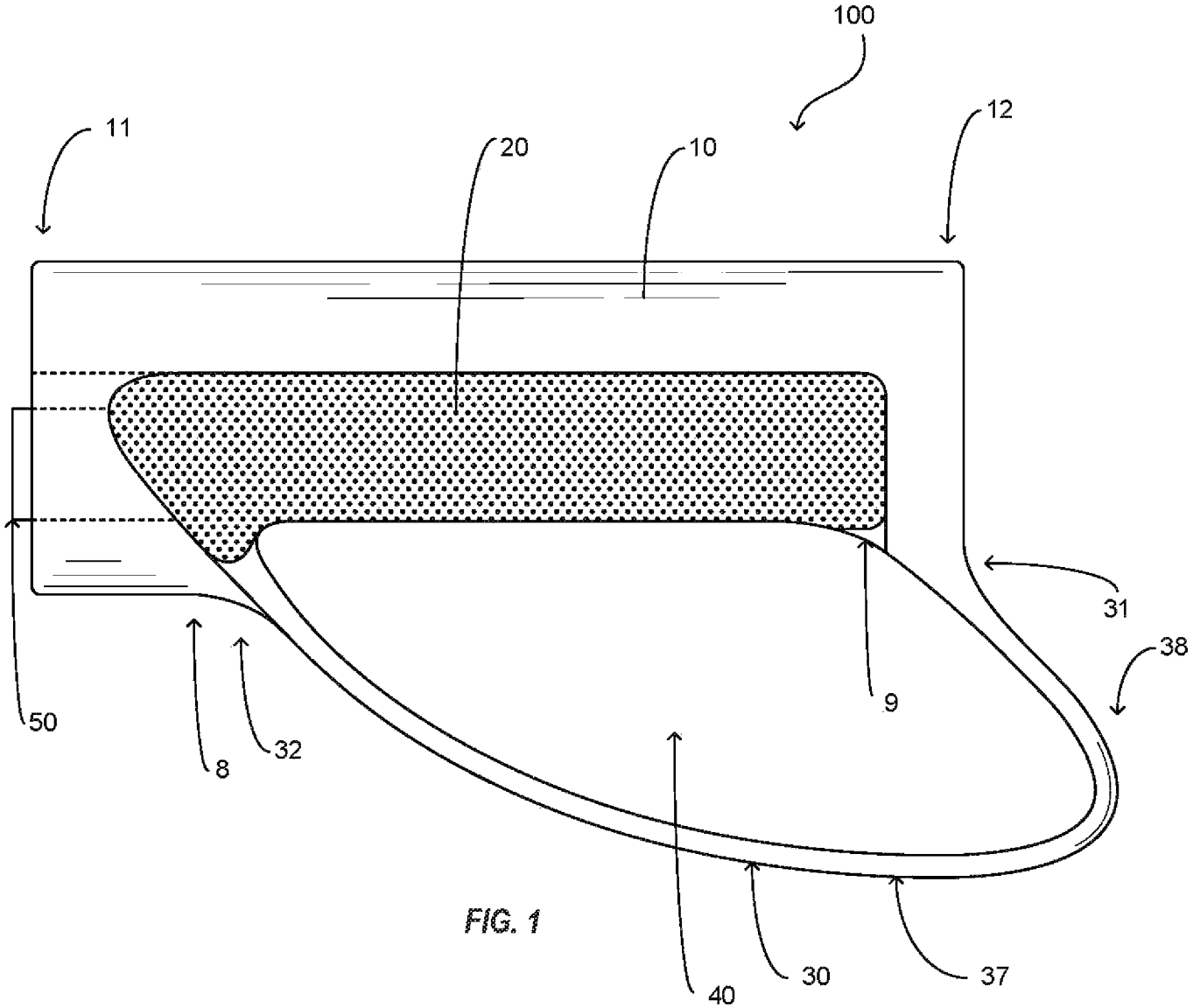
FIG. 1 is a side view of the present invention.
Figure 2:
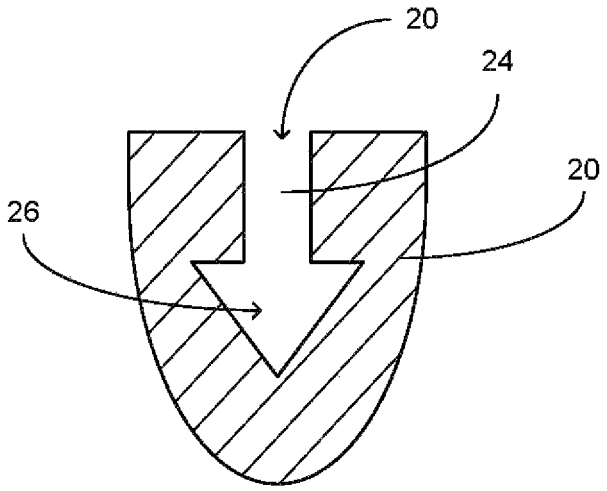
FIG. 2 is a cross section view grip member of the present invention.
Figure 3:
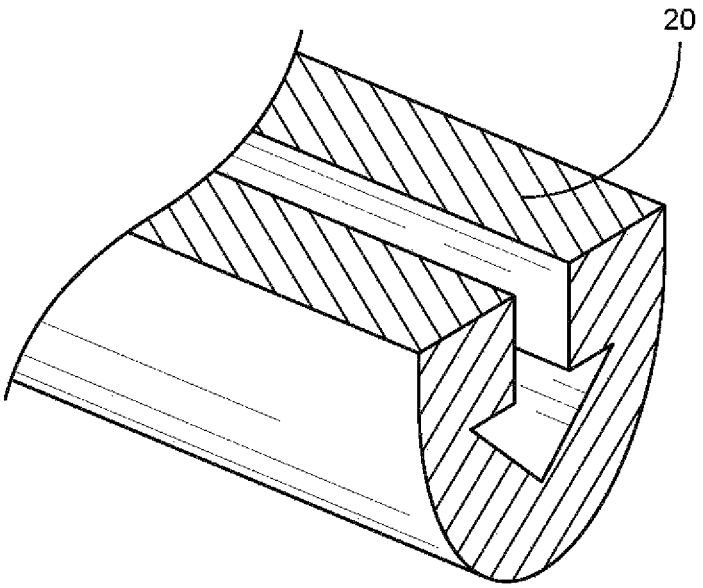
FIG. 3 is a detailed end view of the grip member of the present invention.
Figure 4:
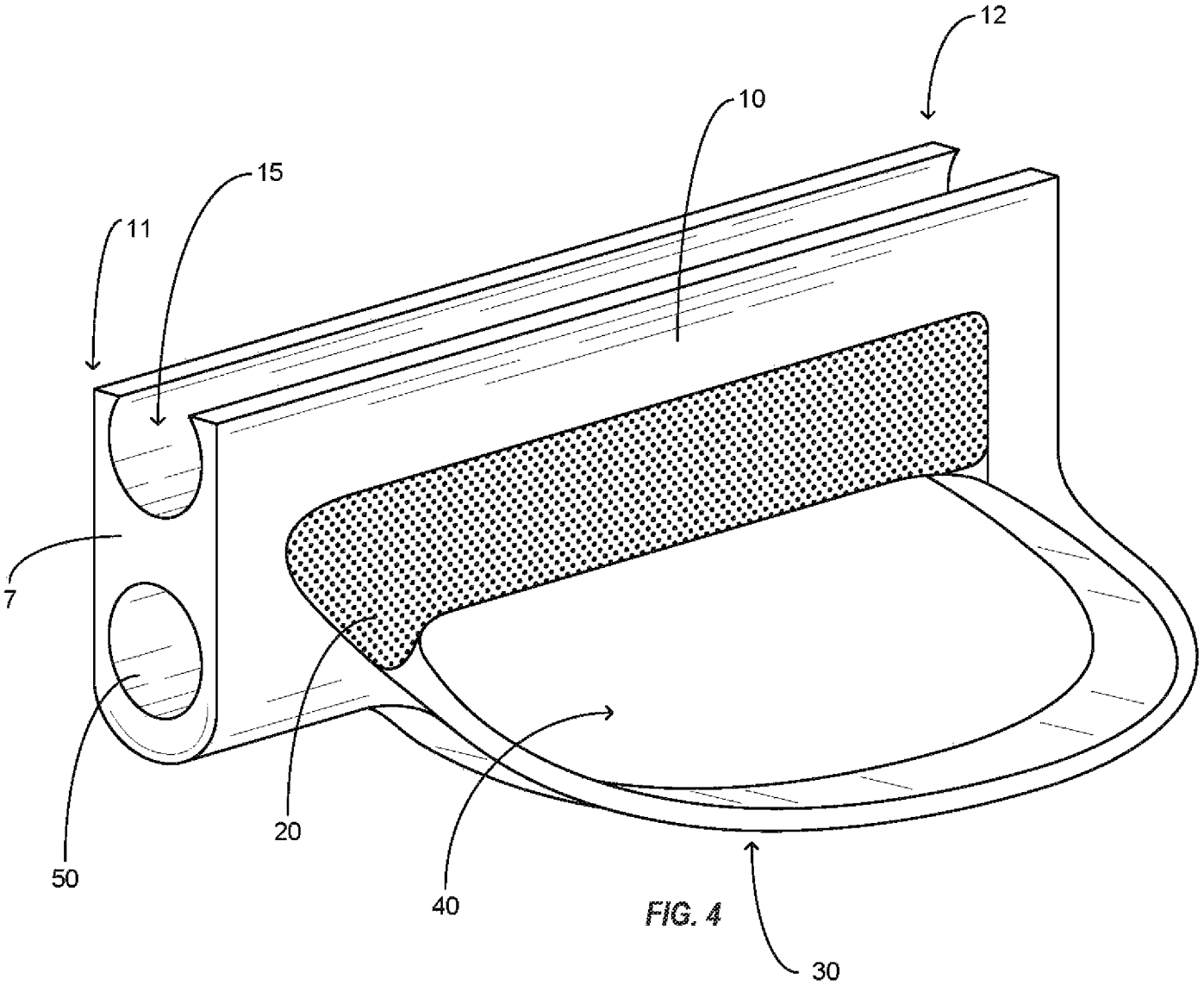
FIG. 4 is a front perspective view of the present invention.

Referring now to the drawings submitted herewith, wherein various elements depicted therein are not necessarily drawn to scale and wherein through the views and figures like elements are referenced with identical reference numerals, there is illustrated a shotgun pump handle 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the shotgun pump handle 100 includes a body 10 wherein the body 10 includes a first end 11 and second end 12. The body 10 includes channel 15 wherein the channel 15 extends the length of the body 10 extending from the first end 11 to the second end 12. The channel 15 is formed and configured to facilitate slidable mounting to a magazine tube (not illustrated herein) of a shotgun that is adjacent and underneath the barrel of the shotgun. In a preferred embodiment of the body 10, the body 10 is manufactured from a durable material such as but not limited to aluminum. It is contemplated within the scope of the present invention that the body 10 could be manufactured in various lengths.

The body 10 has releasably coupled thereto a grip member 20. The grip member 20 is manufactured from an alternate material from the body 10. In a preferred embodiment of the present invention, the grip member 20 is manufactured from foam rubber. The grip member 20 employs passage 22 to slidably and releasably couple to the body 10. The grip member 20 in a preferred embodiment of the present invention is provided in alternate widths so as to facilitate an ability for a user of the shotgun pump handle 100 to select and install a grip member 20 that provides the desired feel. The passage 22 includes a first portion 24 and second portion 26 that are contiguously formed. The passage 22 extends the length of the grip member 20. Second portion 26 is perpendicular to the first portion 24 wherein this configuration facilitates an ability to slidably traverse the grip member 20 on a mateably shaped protrusion (not particularly illustrated) extending downward from the body 10 but inhibit any downward movement of the grip member 20 subsequent being installed. While the passage 22 is illustrated herein as an element to facilitate the releasable securing of the grip member 20, it is contemplated within the scope of the present invention that the grip member 20 could be releasably secured to the body 10 employing various alternate elements. It is contemplated within the scope of the present invention that the grip member 20 could have a lower portion that would be superposed the upper surface of the loop member wherein this lower portion is also releasably secured in the manner discussed herein for the grip member 20.

The body 10 has integrally formed as a part thereof a loop member 30. The loop member 30 includes a first end 31 that is contiguous with the bottom 9 of the body 10 proximate the second end 12 thereof. The loop member 30 is planar in manner having a second end 32 that is integrally formed with the body 10 proximate bottom section 8 proximate the first end 11 of the body 10. The loop member 30 has an arcuate shape that is operably to create a void 40 wherein the void 40 is intermediate the body 10 and the bottom portion 37 of the loop member 30. The loop member 30 includes rear portion 38 wherein the rear portion 38 extends rearward of the second end 12 of the body 10. The position of the rear portion 38 provides improved leverage during operation of the shotgun pump handle 100. The void 40 is sized so as to accommodate a human hand therethrough. In use the rear portion 38 is adjacent to and engaged with a portion of the hypothenar region of the user's hand that is operably coupled with the shotgun pump handle 100. The leverage provided by the engagement of the rear portion 3 with the hypothenar region of the user's hands enables more rapid utilization of the shotgun pump handle 100. In conjunction with the grip member 20 the loop member 30 ensures an ability to optimally fit a user's hand as the grip member 20 is provided in various sizes to provide adjustment thereof.

The shotgun pump handle 100 further includes a light and laser member 50. The light and laser member 50 is located in the front surface 7 of the body 10 proximate the first end 11. The light and laser member 50 is operable to emit a light beam forward of the body 10 and further emit a laser beam to assist in the targeting of the shotgun to which the shotgun pump handle 100 is operably coupled. It should be understood within the scope of the present invention that the light and laser member 50 could emit various alternate quantities of lumens and further be configured to emit a laser beam either red or green in color. It is further contemplated within the scope of the present invention that the light and laser member 50 could be provided as separate modules instead of an integrated module.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A shotgun pump handle configured to be slidably coupled to a magazine tube of a shotgun wherein the shotgun pump handle comprises:

a body, said body having a first end and a second end, said body having an upper surface and a lower surface, said body having a front surface at said first end of the body, said body having a channel formed in the upper surface, said channel extending from the first end to the second end of the body;

a grip member, said grip member being releasably secured to the lower surface of said body, said grip member being manufactured rubber, said grip member having a passage, said passage operable to facilitate releasable securing of the grip member to said body; and a loop member, said loop member having a first end and a second end, said first end of said loop member being integrally formed with said lower surface of said body proximate said second end of said body, said second end of said loop member being integrally formed with said lower surface of said body proximate the first end of said body, said loop member being arcuate in shape creating a void, said void being of suitable size to accommodate a human hand therein, said loop member having a rear portion.

2. The shotgun pump handle configured to be slidably coupled to a magazine tube of a shotgun as recited in claim 1, wherein said rear portion of said loop member extends beyond said second end of said body.

3. The shotgun pump handle configured to be slidably coupled to a magazine tube of a shotgun as recited in claim 2, wherein said passage includes a first portion and a second portion, said first portion and said second portion being contiguous.

4. The shotgun pump handle configured to be slidably coupled to a magazine tube of a shotgun as recited in claim 3, wherein said second portion of said passage is perpendicular to said first portion.

5. The shotgun pump handle configured to be slidably coupled to a magazine tube of a shotgun as recited in claim 4, wherein said grip member is provided in at least two sizes having alternate widths.

6. The shotgun pump handle configured to be slidably coupled to a magazine tube of a shotgun as recited in claim 5, and further including a light and laser member, said light and laser member being mounted in said front surface of said body.

* * * * *